US006250228B1

(12) United States Patent
King

(10) Patent No.: US 6,250,228 B1
(45) Date of Patent: Jun. 26, 2001

(54) COMPRESSION SHOTGUN CARTRIDGE

(76) Inventor: Franklin H. King, 3950 Coburg Rd., SPC/34, Eugene, OR (US) 97408

( * ) Notice: Subject to any disclaimer, the term of this patent is extended or adjusted under 35 U.S.C. 154(b) by 0 days.

(21) Appl. No.: 09/595,563

(22) Filed: Jun. 14, 2000

(51) Int. Cl.[7] ..... F42B 7/00; F42B 12/38
(52) U.S. Cl. ..... 102/458; 102/513
(58) Field of Search ..... 102/448–461, 102/532, 513

(56) References Cited

U.S. PATENT DOCUMENTS

| | | | | |
|---|---|---|---|---|
| 875,762 | * | 1/1908 | Winans et al. | 102/457 |
| 1,457,337 | * | 6/1923 | Barrows | 102/458 |
| 2,440,568 | * | 4/1948 | Orter | 102/455 |
| 3,796,157 | * | 3/1974 | Anderson | 102/451 |
| 4,167,904 | * | 9/1979 | Ferri | 102/457 |
| 4,635,555 | * | 1/1987 | Ferri | 102/453 |
| 4,733,613 | * | 3/1988 | Bilsbury et al. | 102/450 |
| 4,773,329 | * | 9/1988 | Bilsbury | 102/451 |
| 5,299,502 | * | 4/1994 | Maki | 102/457 |
| 5,429,054 | * | 7/1995 | Topping | 102/458 |

FOREIGN PATENT DOCUMENTS

| | | | | |
|---|---|---|---|---|
| 632203 | * | 7/1936 | (DE) | 102/449 |
| 1454931 | * | 10/1966 | (FR) | 102/454 |
| 1427005 | * | 3/1976 | (GB) | 102/449 |

* cited by examiner

*Primary Examiner*—Harold J. Tudor

(57) ABSTRACT

A shotgun casing tube supporting a metal butt end connected containment cup, mounted to the casing tube outer wall, supporting an eject disc, supporting in a percussion cap centrally locate by crimp within a port. A multi-slot fingered antifriction cup is fitted into the casing cup with its floor resting on a powder filled basin at bottom of casing tube. A compressible compression rod conforming to the remaining depth of the casing tube is bonded central to a compression rod base plate, sitting on the floor of the antifriction disc inside a steel shot casing fill sealed in by crimping over extended casing tube end, ready for firing. Another embodiment fill of the shotgun cartridge includes a multi-fingered compressible compression cup bonded to the internal wall of the antifriction cup fingers, matching finger to finger bond. Another embodiment fill includes a tracer powder filled tracer tube, beveled at the leading end open port. The base end of which supports equidistant air fins around the outer circumferential wall to promote true air flight. Exhaust ports are stationed equidistant between fins for powder expulsion in flight. A tracer tube dead end cap sealing in tracer powder rests on the floor of the antifriction cup. A steel shot charge is loaded and sealed in by a crimping the cartridge case muzzle end.

6 Claims, 4 Drawing Sheets

FIG. 2
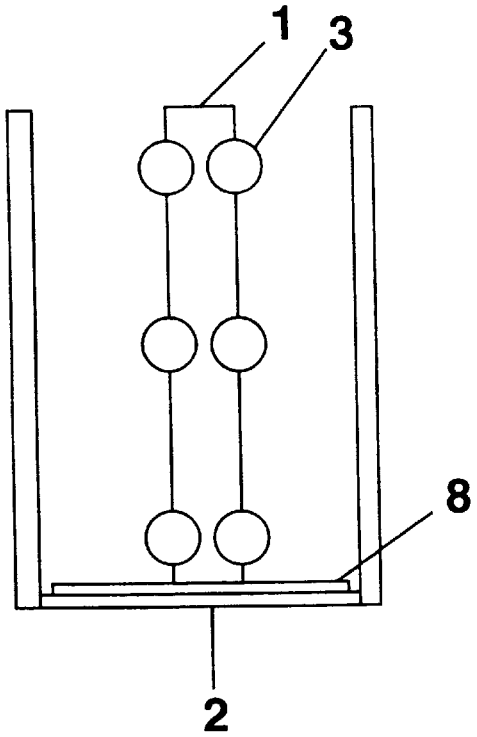
FIG. 3
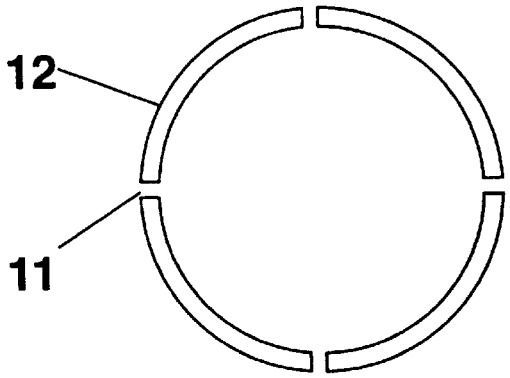
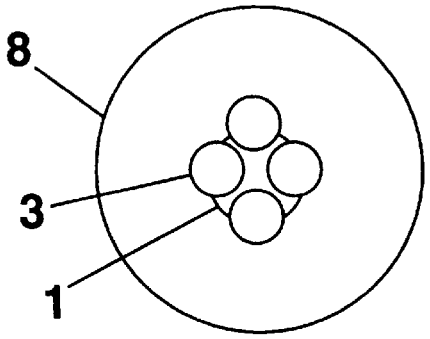
FIG. 4

FIG. 5
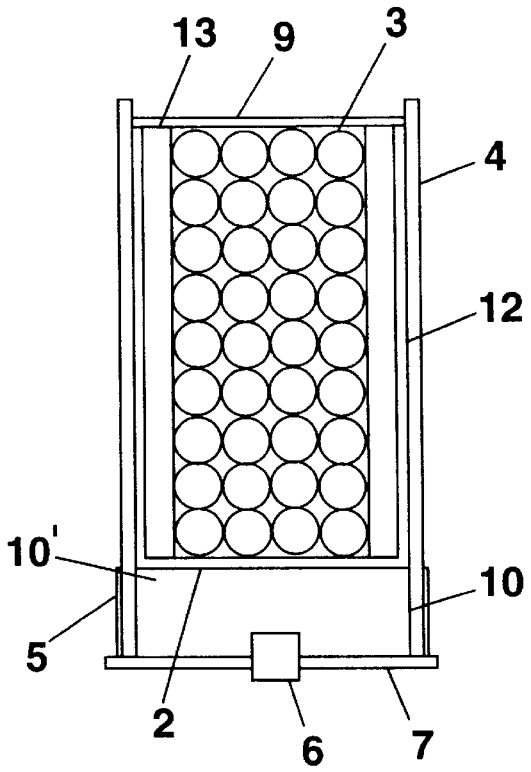
FIG. 6
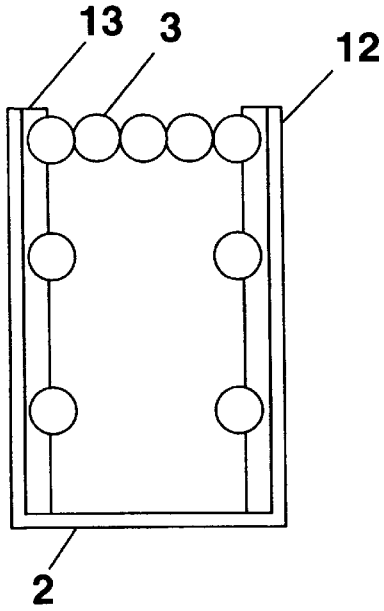
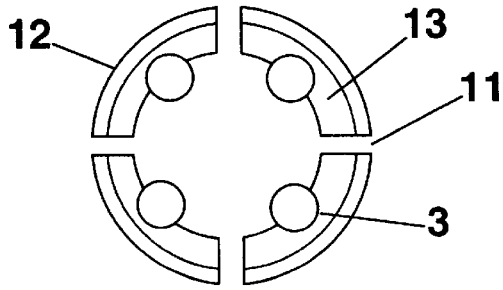
FIG. 7

COMPRESSION SHOTGUN CARTRIDGE

In the past, the Federal Government passed legislation prohibiting hunting water fowl with toxic shot. This shelved the lead shot only shotguns for water fowl hunting. The alternative was to install costly steel shot, accommodating chokes or use expensive bismuth metal shot.

BACKGROUND OF THE INVENTION

The present invention relates to a shotgun cartridge to be used in hunting or skeet shooting in general.

There is a need for a steel shot loaded shotgun cartridge that can be safely fired through barrels designed for lead shot only. This cartridge should be constructed to facilitate a shrinkage. Nontoxic shot is lighter in weight than lead shot. This causes loss of killing range which is 80 yards with lead shot. Closer shooting and more lead on flying birds has to be used.

Lead on flying birds is difficult for most bird hunters, even with lead shot.

The newly designed 3½ inch shotgun cartridges overcomes some of the yardage loss but lead is still a factor. The older barrels are not chambered for 3½ inch cartridges.

There is a need for a means to identify a proper lead, hunting flying birds and kill distance. More cartridges are wasted in bird hunting than in any other type shotgun hunting. Lead and judging proper distance before firing are the major causes of misses or near misses. This is the cause of wounded suffering birds and expensive cartridge waste.

There is a need for a means of identifying lead and kill distance in bird hunting.

SUMMARY OF THE INVENTION

The present invention overcomes the disadvantages of prior art shotgun cartridges, and provides improvements previously considered outside the scope of operation of shotgun cartridges. In addition the present invention makes for a more skillful and economic form of shotgun bird hunting.

As used herein the term "compression rod cartridge" refers to a shotgun cartridge casing containing a centrally located "compression rod" within its inner confines.

As used herein the term "compression cylinder" cartridge refers to a shotgun cartridge casing containing a compressible cylinder within its inner confines.

As used herein the term "tracer cartridge" refers to a shotgun cartridge casing containing a powder filled "tracer tube" element, centrally located within its inner confines.

It is an object of the present invention to create a shotgun cartridge load that shrinks to the diameter of the barrel choke and passes through without damage to the choke diameter.

It is another object of the present invention to create a shotgun cartridge containing a powder filled tracer tube with a nonflammable, non-oxidizing, non-polluting, biodegradable powder such as calcium carbonate.

Other embodiments, features and advantages of the invention become apparent upon reading the specifications.

BRIEF DESCRIPTION OF THE DRAWING

FIG. 2 is a cutaway side elevation view of an anti-friction cup shown in FIG. 1 in the fired condition in a shotgun barrel choke portion, supporting a compression rod.

FIG. 3 is a sectional end view of the outer embodiments of FIG. 2 antifriction cup.

FIG. 4 is a sectional top plan view of the inner embodiment of FIG. 2 in the discharged condition in the barrel choke position.

FIG. 5 is a cutaway side elevation view of another embodiment showing a compression cylinder shotgun casing in the unfired condition.

FIG. 6 is a cutaway side elevation view of the discharging embodiments of FIG. 5 in the choke portion of the barrel of a shotgun.

FIG. 7 is a sectional end view of discharging embodiments in the choke portion of the barrel of the shotgun.

DETAILED DESCRIPTION OF THE INVENTION

Figure 1:
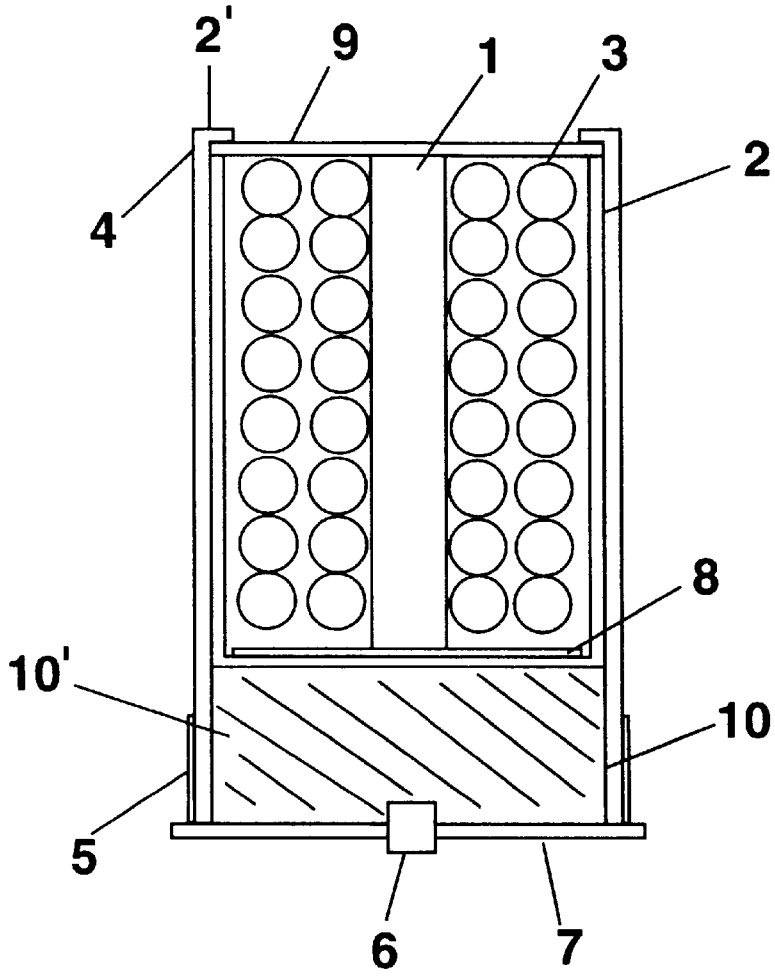
FIG. 1 is a cutaway side elevation view of one embodiment of a compression rod shotgun shell in the unfired condition.

FIGS. 1–4 shows one of the preferred embodiments according to the invention of a "compression shotgun" cartridge. A conventional shot cartridge case 4 supports a butt end attached metal cap 5, in turn supporting a percussion cap 6, crimped in place in a central located open port in a cartridge eject plate 7. The percussion cap in turn protrudes into a powder basin 10 filled with an ignitable gun powder 10'. An antifriction cup 2 supporting multiple slot formed fingers is fitted within the cylinder of casing 4 to rest on the powder 10'. This forms the powder basin 10. The outer wall of the antifriction cup fingers 12 are enmesh with the inner wall of the cartridges casing 4. A compression rod 1 is centrally bonded to a compression rod base plate disc 8 diametered to the diameter of the inner wall of the antifriction cup fingers 12. The compression rod base plate disc 8 is set on the floor of the antifriction cup 2. A steel shot 3 fill is then poured into the open areas surrounding the compression rod 1 from the inner surface of the compression rod base plate disc 8 to a point short of fill. A cartridge cap disc 9 is fitted over the fill and crimped in place by machine roll over crimp 2' off the over extend casing 4 end. This in turn seals the contents. The cartridge is then loaded into the chamber of the shotgun to be fired.

On firing the FIG. 2 casing the contents travel through the barrel compressing in the choke portion of the barrel. Compression rod 1 affords relief of pressure to the steel shot 3 wad. This allows the steel shot 3 wad to compress to a safe choke diameter.

This prevents over pressure to the protected barrel choke.

FIGS. 2 & 4 show steel shot 3 compressed into the compression rod 1 when passing through the barrel choke.

FIG. 3 shows antifriction cup finger 12 separated by slots 11. The antifriction cup 2 could be constructed of plastic or fiber composition.

FIGS. 2–4 shows the compression rod bonded to and supported by the compression rod base plate disc 8.

Figure 1A:
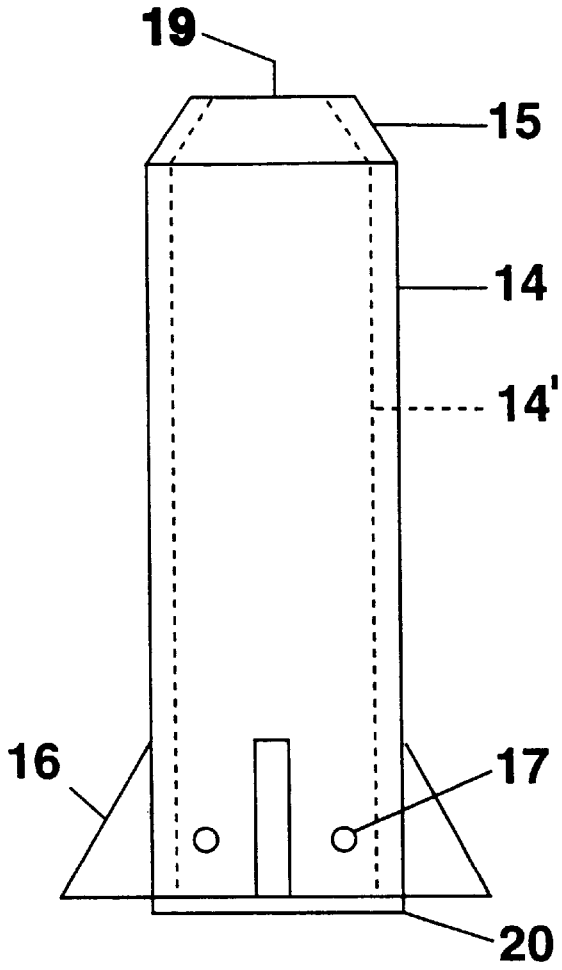
FIG. 1*a* is a side elevation view showing a change of FIG. 1 in that a finned tracer tube replaces the compression rod.
Figure 1B:
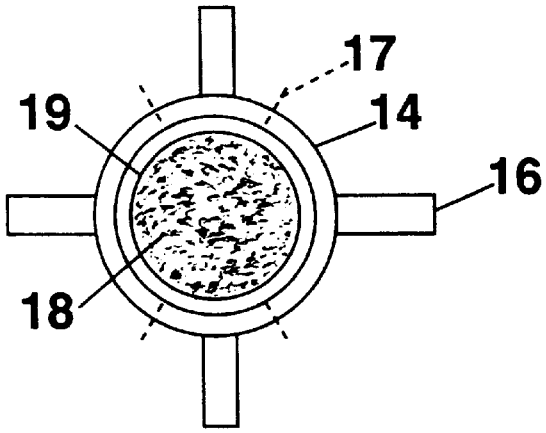
FIG. 1*b* is a top end view of FIG. 1*a* showing fins and the tracer head open port.

FIGS. 1*a* & 1*b* show another embodiment to be fitted into a shotgun cartridge, in the same manner as FIG. 1, compression rod 1. FIG. 1*a* shows a tracer tube head 14, and a streamlined beveled tracer tube head 15. 16 are air foil fins, 17 are open exhaust ports, 18 is a tracer powder such as calcium carbonate. 19 is an open port to the powder chamber 14 at the tracer tube beveled head 15. Dead end cap 20 retains the powder 18 within the confines of a powder chamber 14'.

As the trace tube contained shotgun cartridge is fired through and out of a shotgun barrel, air pressures into open port 19 and forces the powder 18 out exhaust ports 17. In turn, wind pressure past ports 17 creates suction atomizing of powder 18 into the air. Some powder 18 is forced out of exhaust ports 17 and 19 by choke pressure. This is expelled into the air outside the barrel. Atomizing from the tracer head open port 19 is also created by air pressure. Proper diametering of open port 19 will meter out the powder 18 evenly through open ports 17 & 19 as the tracer tube leaves the barrel. The exhausting powder 18 leaves a vapor trail to target area showing flight of accompanying shot 3. Fins 16 and bevel head 15 hold the trace tube 14 in true flight with steel shot 3. The tracer tube material could be made from a plastic or fiber source.

FIGS. 5–7 show a further embodiment of the present invention showing a conventional shotgun cartridge 4 constructed as covered in FIG. 1; details of construction, with a change that a compression cylinder supporting slotted fingers 13, replaces Compression Rod 1, as a compression source. Fingers 13 outer circumferential wall are bonded to the inner wall of the matching antifriction fingers 12. FIG. 7 sectional end view shows the antifriction cup 2, fingers 12 inner wall bonded to the outer wall of the matching compression cylinder fingers 13. FIG. 7 shows antifriction cup fingers 12 segmented from the body proper floor. FIG. 6 shows a two piece compression cylinder assembly formed by the bonding of fingers 12 and 13 together inside antifriction cup 2. FIG. 5 compression cylinder 13 is filled by placing steel shot 3 into the two piece compression cylinder cup, by crimping of the cartridge cap over contents as described for FIG. 1 assembly. The compression cylinder when placed into the barrel chamber and fired through the barrel, diameter shrink of the steel shot 3 load is accomplished passing through the choke. Compression is directed outward forcing the steel shot 3 to recede into the compression material of fingers 13. This allows a diameter flow through of steel shot 3 conforming to that of the choke diameter. This prevents swelling over pressure to the choke that would cause diameter enlargement or rupture. FIGS. 6 & 7 show position of the compressed steel shot 3 into the compressible material of fingers 13. 11 is the common dividing slots to fingers 12 and 13.

There has been described novel shotgun cartridges. It is evident that those skilled in the arts may now make numerous uses and modifications of, and departures from the specific embodiments described herein without departing from the incentive concepts. Consequently the invention is to be construed as embracing each and every feature and novel combination of features present or possessed by shotgun cartridges, herein disclosed and limited solely by the spirit and scope of the appended claims.

What is claimed is:

1. A tracer tube adapted to be centrally located within a shotgun cartridge comprising:

a hollow body having a cylindrical wall, a longitudinal axis, and upper and lower ends;

said upper end of said hollow body having a beveled cap attached thereto, said cap having an opening in a central part thereof, said opening communicating the interior of said hollow body with the exterior thereof;

said lower end of said hollow body having an end cap closing communication between the interior of said hollow body and the exterior thereof;

a plurality of exhaust ports extending through said hollow body adjacent said lower end thereof, said exhaust ports communicating the interior of said hollow body with the exterior thereof;

a plurality of air foil fins attached to said hollow body adjacent the lower end thereof; and a non-flammable, non-polluting tracer powder packed within the interior of said hollow body.

2. The tracer tube of claim 1 wherein said tracer powder is calcium carbonate.

3. The tracer tube of claim 1 wherein said fins have major planes that intersect said longitudinal axis of said hollow body.

4. In a shotgun cartridge having a casing, a butt end metal cap, a cartridge eject plate including a percussion cap, a powder basin filled with ignitable gun powder, an antifriction cup located above the powder basin, steel shot located in the antifriction cup, and a cartridge cap disc crimp sealed to the casing, the improvement comprising positioning a tracer tube in the longitudinal center of said antifriction cup, said steel shot surrounding said tracer tube, said tracer tube comprising:

a hollow body having a cylindrical wall, a longitudinal axis, and upper and lower ends;

said upper end of said hollow body having a beveled cap attached thereto, said cap having an opening in a central part thereof, said opening communicating the interior of said hollow body with the exterior thereof;

said lower end of said hollow body having an end cap closing communication of the interior of said hollow body with the exterior thereof;

a plurality of exhaust ports extending through said hollow body adjacent said lower end thereof, said exhaust ports communicating the interior of said hollow body with the exterior thereof;

a plurality of air foil fins attached to said hollow body adjacent the lower end thereof; and a non-flammable, non-polluting tracer powder packed within the interior of said hollow body.

5. The cartridge of claim 4 wherein said tracer powder is calcium carbonate.

6. The cartridge of claim 4 wherein said fins have major planes that intersect said longitudinal axis of said hollow body.

* * * * *